US005881794A

United States Patent [19]

Harada et al.

[11] Patent Number: 5,881,794

[45] Date of Patent: Mar. 16, 1999

[54] APPARATUS AND METHOD FOR PRODUCING SHELL-LIKE MOLDS

[75] Inventors: Hisashi Harada, Hoi-gun; Kazuo Sugimoto, Toyokawa; Nagato Uzaki, Toyohashi, all of Japan

[73] Assignee: Sintokogio, Ltd., Nagoya, Japan

[21] Appl. No.: 959,104

[22] Filed: Oct. 23, 1997

Related U.S. Application Data

[63] Continuation of Ser. No. 539,300, Oct. 4, 1995, abandoned.

[30] Foreign Application Priority Data

Oct. 7, 1994 [JP] Japan ..... 6-270582
Oct. 28, 1994 [JP] Japan ..... 6-289032

[51] Int. Cl.[6] ..... B22C 15/23

[52] U.S. Cl. ..... 164/7.1; 164/15; 164/160.1

[58] Field of Search ..... 164/6, 7.1, 7.2, 164/15, 19–22, 27, 29, 38, 39, 160.1, 160.2, 165, 166, 192, 195, 200, 203; 249/112; 264/219, 220, 221

[56] References Cited

U.S. PATENT DOCUMENTS 3,751,540 8/1973 Prahl, Jr. et al. ..... 264/220
4,454,906 6/1984 Musschoot ..... 164/39
4,579,162 4/1986 Quinn, Jr. ..... 164/21
4,724,888 2/1988 Buhler ..... 164/7.1

FOREIGN PATENT DOCUMENTS 441646 11/1948 Italy ..... 164/29
55-141357 11/1980 Japan ..... 164/39
57-85643 5/1982 Japan .

*Primary Examiner*—Kuang Y Lin
*Attorney, Agent, or Firm*—Limbach & Limbach L.L.P.

[57] ABSTRACT

An apparatus to produce a shell-like mold by vacuum sucking molding sand into a shell-like cavity defined by a cope and a drag is disclosed. The apparatus includes a drag and a cope mounted on the drag so that they define a shell-like cavity between them. The drag holds on its upper surface a pattern. The drag has a plurality of sucking apertures at places adjacent to the perimeter of the pattern. The sucking apertures communicate with a vacuum source. The cope has a single molding-sand-supplying bore which communicates with the cavity. To produce a shell-like mold, the molding sand is introduced from the bore into the cavity by means of a vacuum source.

3 Claims, 2 Drawing Sheets

APPARATUS AND METHOD FOR PRODUCING SHELL-LIKE MOLDS

This is a continuation of application Ser. No. 08/539,300 filed on Oct. 4, 1995, now abandoned.

BACKGROUND OF THE INVENTION

1. Field of the Invention

This invention relates to an apparatus and method for producing a shell-like mold by introducing self-curing or gas-cured molding sand by vacuum sucking it into a shell-like cavity defined by a cope and a drag, wherein the amount of molding sand used is reduced.

2. Prior Art

Japanese Patent (A) 57-85643 discloses a method to produce a shell-like or thin mold to reduce the amount of molding sand to be used. As shown in FIG. 4 of the attached drawings, the method uses a drag 2 and a pattern 4 disposed above the drag to serve as a cope. The pattern 4, i.e., a cope, is spaced apart from the drag 2 so that the cope and drag define a shell-like cavity 6 therebetween. The drag has a plurality of vertical sucking throughbores 8 therein. The throughbores 8 are in communication with a vacuum source (not shown) through a duct 10. The pattern 4 at its perimeter has a plurality of molding-sand-supplying bores 12 through which molding sand is fed into the cavity 6. To introduce the molding sand into the cavity 6 and to produce a shell-like mold, the vacuum source is activated, and a vibratory table 14 on which the drag 2 is mounted is driven.

The method described above has the following drawbacks:

(a) As the pattern is disposed on the drag with the pattern surface facing downward, the molding sand charged in the cavity tends to move down due to gravity and due to the vibrations of the table, i.e., the sand tends to separate from the pattern surface. Thus the molding sand does not completely fill the cavity to the pattern surface. Accordingly, the desired shape of the mold, which must correspond to that of the pattern surface, cannot be obtained.

(b) Since the pattern extends downward, it requires a plurality of molding-sand-supplying bores at its perimeter. When such bores are used, generally the amount of molding sand fed or sucked through each bore 12 differs, and therefore an extra amount of molding sand must be previously prepared in a hopper. This contradicts the purpose of the invention, which is to minimize the amount of sand used.

(c) Since the sand in the bores 12 remains on the surface of the produced mold, troublesome work to remove the remaining sand is necessary.

(d) As a plurality of throughbores 8, which communicate with the cavity, are disposed, the sand tends to accumulate at the entrances of the throughbores 8 (in FIG. 4 only one throughbore where the sand accumulates is shown, and it is designated by 16). This accumulated sand prevents the molding sand from flowing to a neighboring throughbore.

SUMMARY OF THE INVENTION

This invention is made in view of these drawbacks. This invention aims to provide an apparatus and method for producing a shell-like mold without such drawbacks wherein the amount of molding sand to be used is minimized.

The apparatus of the invention includes a cope disposed above a drag. The cope and drag define a shell-like cavity between them. The drag holds a pattern on its upper surface. A plurality of sucking apertures are formed in the drag at places which are adjacent to the perimeter of the pattern. The cavity communicates with a vacuum source via sucking apertures. The cope has a single opening through which molding sand is introduced into the cavity by means of the vacuum source. This apparatus enables the production of a mold of a precise configuration, and minimizes the amount of molding sand used.

This invention also relates to a method for producing a shell-like mold by vacuum sucking molding sand into a shell-like cavity defined by a cope and a drag. The method includes the steps of placing a pattern on the upper surface of a table, forming a plurality of sucking apertures in the table at places adjacent to the perimeter of the pattern so that the sucking apertures can communicate with a vacuum source, activating the vacuum source, thereby via the sucking apertures sucking a flexible and non-air-permeable member which is substantially equal in thickness to the mold to be produced so that the member is pressed against the pattern, disposing a frame on the table to encircle the non-air-permeable member, disposing a member on the non-air-permeable member so as to form a single molding-sand-supplying bore, charging heat-resistant and self-curing material in a space defined by the non-air-permeable member, the frame, and the member for forming the molding-sand-supplying bore, releasing the hardened material from at least the table, the pattern, and the non-air-permeable member after the self-curing material has hardened, placing the released hardened material as a cope above a drag which holds a pattern on the upper surface of the drag so as to form a cavity between the cope and the drag, feeding molding sand into the cavity through the molding-sand-supplying bore formed in the cope and sucking the cavity by applying a vacuum at places adjacent to the perimeter of the pattern, thereby introducing the molding sand into the cavity, and removing the pattern and the drag from the introduced and molded sand to form a mold backed by the heat-resistant hardened material. By this method, a mold of a precise configuration can be produced while minimizing the amount of molding sand used.

DESCRIPTION OF THE PREFERRED EMBODIMENTS

The embodiment of the invention will be now explained in detail by reference to the accompanying drawings.

Figure 1:
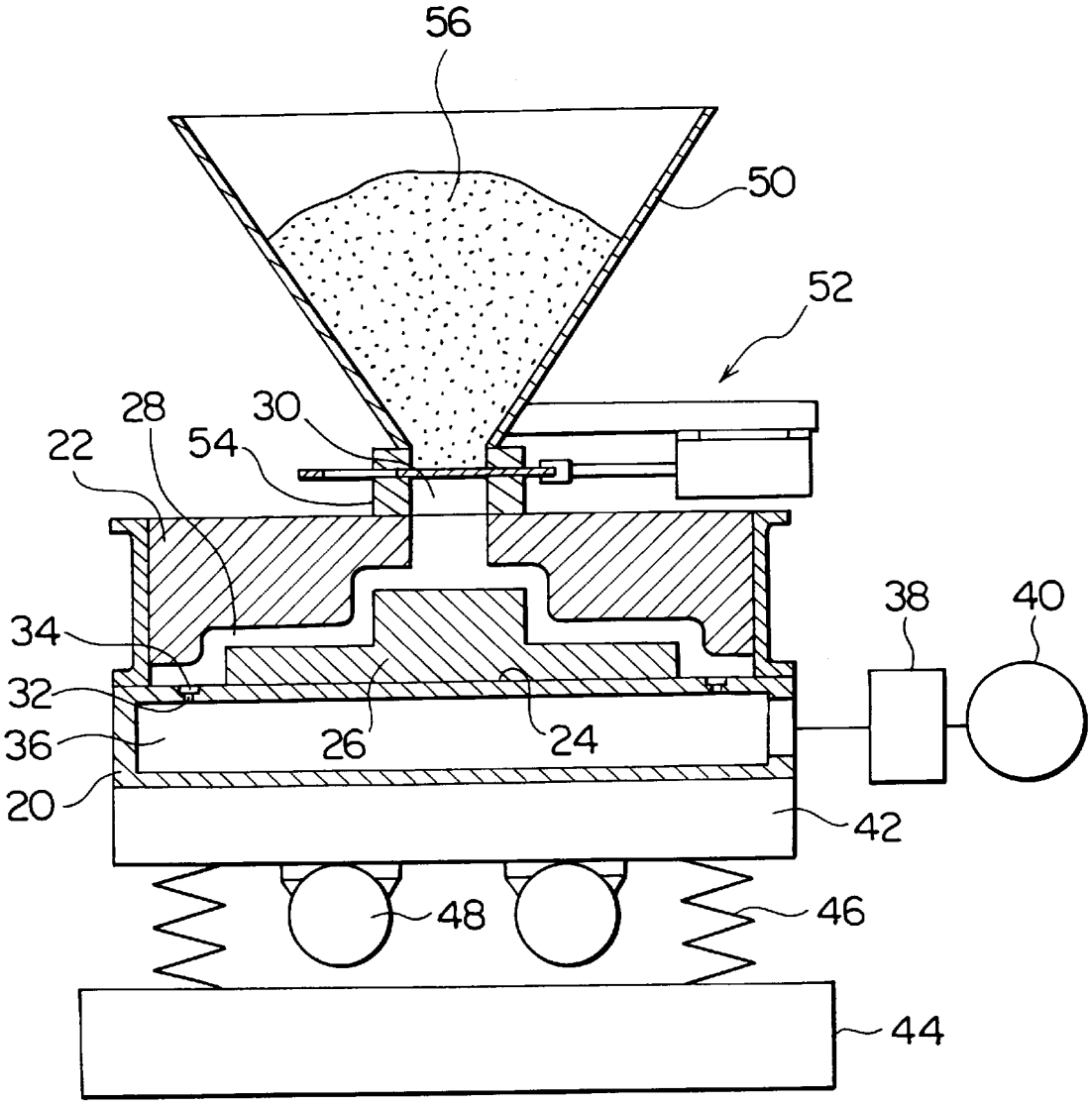
FIG. 1 is a partly cross-sectional side view of the embodiment of the apparatus of the invention.

In FIG. 1 an apparatus of the invention to produce a shell-like mold is shown. The apparatus includes a drag 20 and a cope 22. The drag 20 on its upper surface 24 holds a pattern 26 which projects upward. The cope 22 is installed above the drag 20 such that a shell-like cavity 28 is defined between them. The thickness of the thin cavity 28 is substantially uniform at all parts. A molding-sand-supplying bore 30 is formed in the upper part of the cope 22 such that the bore 30 communicates with the cavity 28. The bore 30 is preferably located in the central part of the cavity.

The present invention also relates to a method of producing a cope such as the cope 22. This method will be explained below.

A plurality of vent holes 32, each having a vent plug 34, are formed in the upper surface 24 of the drag 20. The holes 32 are adjacent to the perimeter of the pattern 26 and are in communication with a void or chamber 36 formed in the drag 20. The chamber 36 communicates with a gate valve 38, which is connected to a vacuum source 40.

The drag 20 is mounted on a vibratory table 42 which is in turn mounted on a base 44 through coil springs 46. A plurality of vibrators 48 are mounted on the vibratory table 42. A sand-containing hopper 50 having at its lower part a gate device 52 is placed on the sand-supplying bore 30 of the cope 22 through an annular piece of elastomeric material 54. The discharging port of the hopper 50 can be opened or closed by the gate device 52.

The method of producing a shell-like or thin mold, which is supported by the cope 22, will now be explained. First, the gate valve 38 connected to the vacuum source 40 is opened to lower the air pressure in the cavity 28 through the chamber 36, while the vibrators 48 are activated to apply vibrations to the drag 20. Then, the gate device 52 is opened. Accordingly, self-curing or gas-cured molding sand 56 in the hopper 50 is sucked from the bore 30 into the cavity 28. The sand in the cavity 28 is further sucked and moved to the vent plugs 34. Thus the cavity 28 is filled with the molding sand 56, and the sand is well compacted due to the vibrations of the drag 20. After the cavity is filled with the sand, the gate device 52 is closed. Then, after the self-curing molding sand hardens or the gas-cured molding sand is hardened by circulating the curing gas in it, the cope 22, which now holds a mold, is separated from the pattern 26 and the drag 20. Thus the mold, which is supported by the cope (as will be explained below, the cope is made of a hardened or self-curing material such as cement) is produced. The bore 30 of the supported mold is filled with the molding sand. The upper surface of the filled bore may be flush with or slightly recessed from the upper surface (the top surface in FIG. 1) of the cope.

Since during the process of making the mold the molding sand is pressed against the surface of the pattern due to gravity, the vibrations of the drag, and the suction force by the vacuum, the shell-like surface of the mold coincides with that of the pattern. Also, since the molding sand is supplied from a single bore to the cavity and is then sucked towards the cavity's perimeter, which corresponds to the perimeter of the pattern, the molding sand is uniformly charged into the entire cavity. Further, since the vent holes are disposed outside of the surface of the pattern (i.e., outside of the surface of a product to be cast in the mold), post-treatments to finish the surface of the mold are unnecessary.

Figure 2:
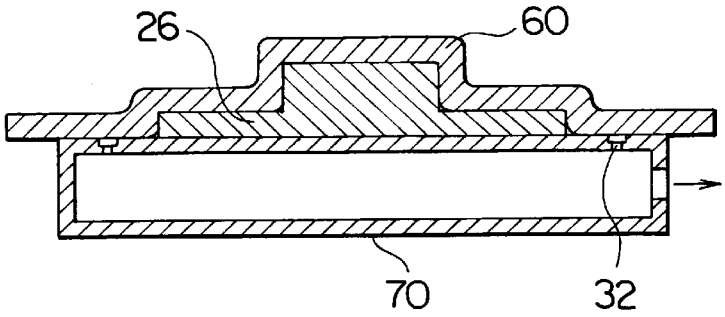
FIGS. 2 and 3 are schematic drawings (partly cross-sectional side views) to explain a method of the invention to produce a cope.
Figure 3:
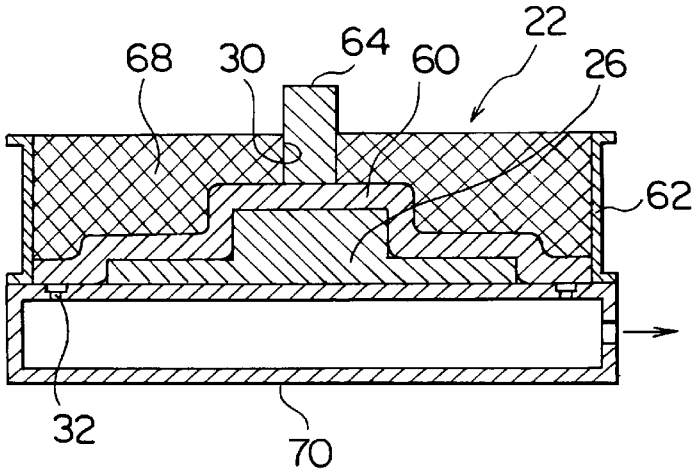
Figure 4:
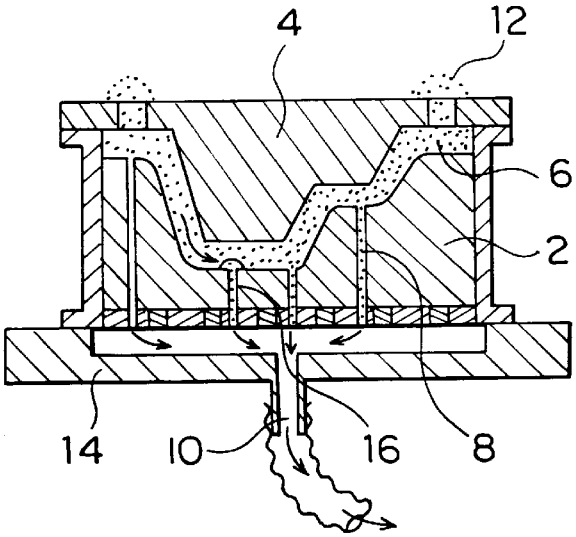
FIG. 4 PRIOR ART
FIG. 4 is a cross-sectional view of a prior-art apparatus which produces a shell-like mold.

Referring to FIGS. 2 and 3, a method of the present invention to produce a cope 22 used for an apparatus for producing a shell-like mold is now explained. The same reference numerals are used for the elements in FIGS. 2 and 3 as in FIG. 1. As shown in FIG. 2, the pattern 26 is placed on a table 70. This table may be of the same structure as that of the drag 20 in FIG. 1 or any other structure which functions the same as it. The pattern 26 and the vent holes 32 are covered with a mat or mat-like member 60 made of a flexible and non-air-permeable material. The mat 60 has a thickness which is substantially equal to that of the shell-like mold to be produced. The mat 60 is sucked by the vacuum source 40 through the gate valve 38 so that it is pressed against the surface of the pattern 26 and the upper surface of the table 70 or drag 20. The rim of the mat 60, which extends beyond the vent holes 32, is cut. At the perimeter of the mat 60 on the table 70 a frame 62 is placed. Also, a solid or hollow cylinder 64 for making a molding-sand-supplying bore 30 is placed on the central part of the mat. Self-curing material 68, such as cement slurry or a thermosetting resin, is cast in the space defined by the mat 60, frame 62, and the cylinder 64. The self-curing material is preferably heat-resistant. After the material hardens, at least the table 70, pattern 26, and non-air-permeable mat 60, are removed from the hardened material 68 and the frame 62, which constitute a cope 22. If the cylinder 64 is hollow, it may remain in the cope. The hollow cylinder 64 itself can serve as a molding-sand-supplying bore.

What we claim is:

1. A method for producing a cope used for an apparatus for producing a shell-like mold by vacuum sucking molding sand into a shell-like cavity defined by a cope and a drag, comprising the steps of:

placing a pattern on an upper surface of a table;

forming a plurality of sucking apertures in said table at places adjacent to the perimeter of said pattern so that said sucking apertures can communicate with a vacuum source;

activating said vacuum source, thereby via said sucking apertures sucking a flexible and non-air-permeable member which is substantially equal in thickness to the mold to be produced so that said member is pressed against said pattern;

disposing a frame on said table so as to encircle said non-air-permeable member;

disposing a member on said non-air-permeable member so as to form a single molding-sand-supplying bore;

charging self-curing material in a space defined by said non-air-permeable member, said frame, and said member for forming said molding-sand-supplying bore; and after said self-curing material has hardened, removing at least said table, said pattern, and said non-air-permeable member from said hardened material.

2. The method of claim 1, wherein the method includes a step of using a drag of the apparatus for producing a shell-like mold as said table.

3. A method for producing a shell-like mold by vacuum sucking molding sand into a shell-like cavity defined by a cope and a drag, said shell-like cavity having substantially uniform thickness, said method comprising the steps of:

placing a pattern on an upper surface of a table;

forming a plurality of sucking apertures in said table at places adjacent to the perimeter of said pattern so that said sucking apertures can communicate with a vacuum source;

activating said vacuum source, thereby via said sucking apertures sucking in a flexible and non-air-permeable member which is substantially equal in thickness to the mold to be produced so that said member is pressed against said pattern;

disposing a frame on said table so as to encircle said non-air-permeable member;

disposing a member on said non-air-permeable member so as to form a single molding-sand-supplying bore;

charging heat-resistant and self-curing material in a space defined by said non-air-permeable member, said frame, and said member for forming said molding-sand-supplying bore;

after said self-curing material has hardened, releasing said hardened material from at least said table, said pattern, and said non-air-permeable member;

placing said released hardened material as a cope on a drag which holds a pattern on an upper surface of the drag so as to form a cavity between said cope and said drag;

feeding molding sand into the cavity through said molding-sand-supplying bore formed in said cope and sucking the cavity by a vacuum at places adjacent to the perimeter of said pattern, thereby introducing the molding sand into the cavity; and removing said pattern and said drag from the introduced and molded sand to form a mold supported by said heat-resistant hardened material.

* * * * *